United States Patent [19]

Truzzi et al.

[11] 4,437,298

[45] Mar. 20, 1984

[54] APPARATUS FOR JOINING TEXTILE THREADS WITH THE AID OF COMPRESSED AIR, FOR MOUNTING ON AN AUTOMATIC WINDING MACHINE

[75] Inventors: Ferdinando Truzzi; Mauro Premi, both of Salo' , Italy

[73] Assignee: Mesdan S.p.A., Salo' , Italy

[21] Appl. No.: 386,681

[22] Filed: Jun. 9, 1982

[30] Foreign Application Priority Data

Jun. 11, 1981 [IT] Italy ..... 22268 A/81

[51] Int. Cl.[3] ..... B65H 69/06; D01H 15/00; D02J 1/08

[52] U.S. Cl. ..... 57/22; 57/261

[58] Field of Search ..... 57/22, 202, 333, 261-263

[56] References Cited

U.S. PATENT DOCUMENTS

| | | | |
|---|---|---|---|
| 3,668,852 | 6/1972 | Fusco et al. | 57/22 |
| 3,822,538 | 7/1974 | Cardell | 57/22 |
| 4,217,749 | 8/1980 | Rohner et al. | 57/261 |
| 4,232,509 | 11/1980 | Rohner et al. | 57/261 |
| 4,263,775 | 4/1981 | Mima | 57/22 |
| 4,344,277 | 8/1982 | Rohner et al. | 57/22 |
| 4,361,003 | 11/1982 | Bertoli | 57/22 |

*Primary Examiner*—John Petrakes

*Attorney, Agent, or Firm*—Cushman, Darby & Cushman

[57] ABSTRACT

An apparatus for joining textile threads with the aid of compressed air, for mounting in an automatic winding machine, comprises, in front of and behind a mixing chamber, opposing walls with guides for positioning the threads laterally to the chamber and perpendicularly to its longitudinal axis. The front wall carries members for crossing-over the threads before their insertion into the chamber. In the vicinity of the positioning guides for the thread locking members, the opposing wall, at which the threads to be joined enter the apparatus, carries adjustable members for adjusting the length of the free ends of the threads after they have been cut, and an adjustable member for operating a valve which controls the entry of compressed air into the chamber. A control drum which can be coupled to a power take-off of the winding machine is provided with profiled cam grooves for controlling the movements of the mobile members of the apparatus. A single profiled groove controls the movements of the locking members, the members for adjusting the length of the free ends, and the member for operating said valve.

12 Claims, 11 Drawing Figures

Figure 1:
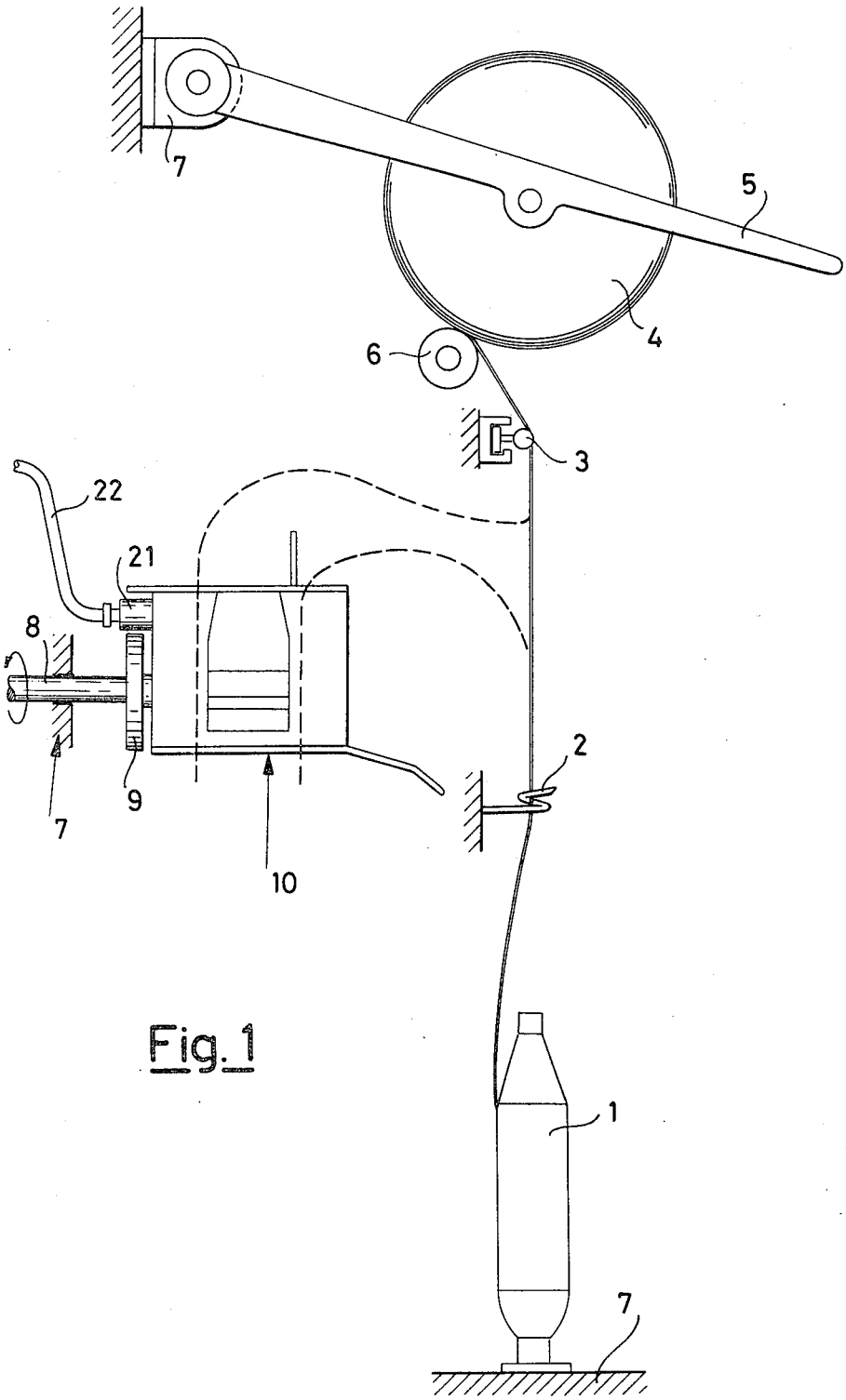

APPARATUS FOR JOINING TEXTILE THREADS WITH THE AID OF COMPRESSED AIR, FOR MOUNTING ON AN AUTOMATIC WINDING MACHINE

This invention relates to an apparatus for joining textile threads with the aid of compressed air, for mounting on an automatic winding machine.

Apparatus able to join textile threads together without forming a knot are known, in which the fibers are simply mixed and interlaced by compressed air.

These apparatus have considerable advantages over conventional knotting devices, because of which they have gained increasingly widespread use in recent times.

The operation of joining textile threads together by simply mixing and interlacing the fibres using compressed air is very delicate, and its proper outcome and reliable repeatability depend on numerous factors which are not easily determinable.

As a result of considerable research and many attempts, apparatus of this type have been constructed which give excellent results and which possess a high degree of reliability and safety.

The first apparatus constructed of this type were portable apparatus with manual control by means of a trigger, but in the course of their further development, it has also been sought to make them usable on automatic winding machines as a replacement for the conventional knotting devices. Instead of the manual control by means of a trigger, a mechanical control system deriving from the winding machine as already provided for knotting devices, and also using the means for inserting the threads to be joined into the joining apparatus provided on automatic winding machines (see for example British patent 1,121,597 and U.S. Pat. Nos. 4,217,749 and 4,232,509).

Reliability and safety requirements are obviously more critical when using joining apparatus on automatic winding machines, as the thread joining operation is no longer continuously controlled directly by an operator.

In designing an apparatus for joining textile threads with the aid of compressed air for mounting on an automatic winding machine, it is therefore necessary not only to take account of many factors which influence the proper outcome of the joining operation, such as the exact positioning of the threads in the apparatus mixing chamber, the length of the free ends of threads to be joined together, the time of action of the burst of compressed air in said mixing chamber etc., but it is also necessary to consider the possibility on the one hand of easy adaptability of the apparatus to different working requirements, and on the other hand of enabling it to be coupled to normally used existing winding machines taking account of the available space and arrangement of those members of the winding machine required to cooperate with the joining apparatus, and in general one must aim at providing a compact, rational and constructionally simple apparatus in order to reduce sources of disturbance to a minimum, and to ensure reliable continuous automatic operation.

In solving these numerous problems, the invention proposes an apparatus for joining textile threads with the aid of compressed air, which has been especially studied and designed for mounting on existing automatic winding machines of the type in which a power take-off is provided for operating the apparatus, and means are also provided for inserting the two threads to be joined together, both from the same side of the apparatus.

The apparatus according to the invention comprises a support structure with a block in which a laterally and frontally open mixing chamber substantially of V cross-section is formed, an aperture opening centrally at the base of said chamber and connected by way of a shut-off valve to a compressed air source, a cover carried by a support movably mounted in said structure so as to frontally close said chamber, means for controlling the movement of said cover from a rest position withdrawn from the chamber to a frontal closure position therefor, means synchronised with said cover movement control means for causing said shut-off valve to open for a predetermined time when the cover is in the position in which it closes the chamber, fixed guides for positioning the threads to be joined together, thread locking members constituted by fixed and mobile elements, members constituted by fixed and mobile blades for cutting the free ends of the threads, and means for controlling the mobile elements of the lockingf members and the mobile blades of the cutting members in synchronism with the movement of the cover, the apparatus being characterised in that said structure is provided with two opposing walls which are parallel to each other and to the longitudinal axis of the mixing chamber and disposed at a distance respectively in front of and behind the block comprising said chamber, the thread positioning guides being provided in said walls in aligned pairs to receive the two threads to be joined together along parallel axes perpendicular to the axis of the chamber and passing to the side of this latter, the two guides provided in the wall disposed in front of the chamber being at different heights, on said wall disposed in front of the chamber there being mounted rocking members for crossing-over the threads in the region between said wall and the mixing chamber, the mobile and fixed elements of the thread locking members and of the mobile levers for adjusting the length of the free ends of the threads being mounted on the wall disposed behind the block comprising the mixing chamber in positions corresponding to the positioning guides provided in this wall, on the same wall there being mounted a member for operating said shut-off valve, the cutting members being disposed at the two sides of the mixing chamber with the mobile blades rigid with the support for the chamber closure cover, in said structure there being mounted a control drum which is rotatable about its axis and can be coupled to said power take-off of the winding machine and is provided with a plurality of cam profiles for controlling the movements of the members for crossing-over the threads, the mobile elements of the thread locking members, the mobile levers for adjusting the length of the free ends of the threads, the operating member for the shut-off valve and the cover with the mobile blades of the thread cutting members.

Advantageously, said control drum is provided with a first cam profile with which there cooperates a control lever pivoted to the wall disposed behind the block comprising the mixing chamber, said control lever being arranged to operate the mobile elements of the locking members, the mobile levers for adjusting the length of the free ends of the threads, and the operating member for the shut-off valve, and is also provided with a second and third cam profile for controlling each of said cross-over members, and a fourth cam profile with which there cooperates a lever pivoted to the support structure and arranged to act on the support of the mixing chamber cover.

The first three profiles are constituted suitably by profiled circumferential grooves provided in the periphery of the control drum, whereas the fourth profile is constituted by a frontal groove cam provided in a front wall of said drum.

As the various stages of the operating cycle carried out by the apparatus during each complete revolution of the control drum are determined and mutually synchronised by the various drum cam profiles, in order to allow ready adaptation to the various operating requirements and to allow simple setting-up of the apparatus without having to change the cam profiles (which would mean that the entire control drum would have to be replaced), suitable adjustment means are provided for two essential functions performed by the apparatus, namely for setting the length of the free ends of the threads laterally emerging from the mixing chamber during the joining operation by means of the burst of compressed air, and for setting the duration of said burst of compressed air.

In this respect, it has been found that these are the two factors which mostly influence the quality of the joint in relation to the types of thread to be joined, and the reliable repeatability of the operation.

Figure 2:
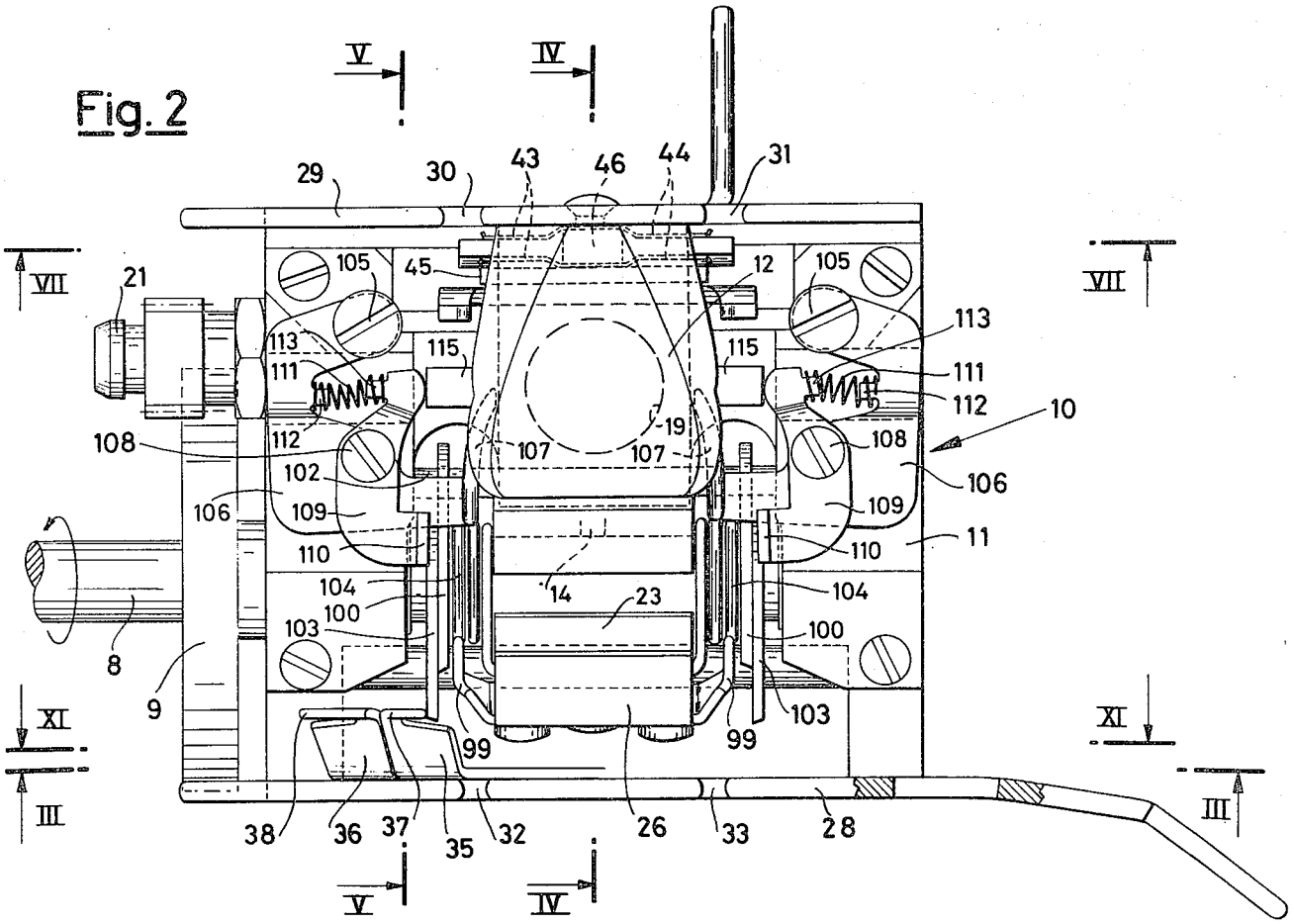
Figure 3:
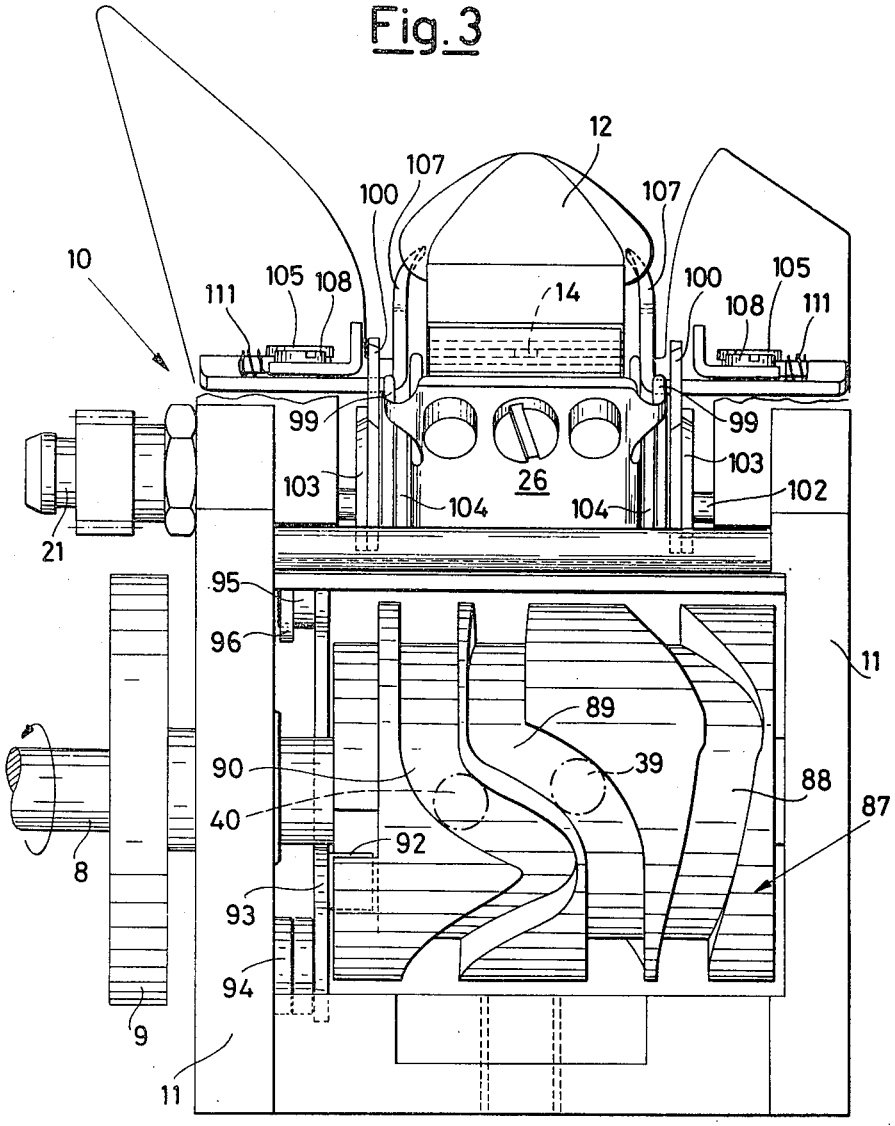
Figure 4:
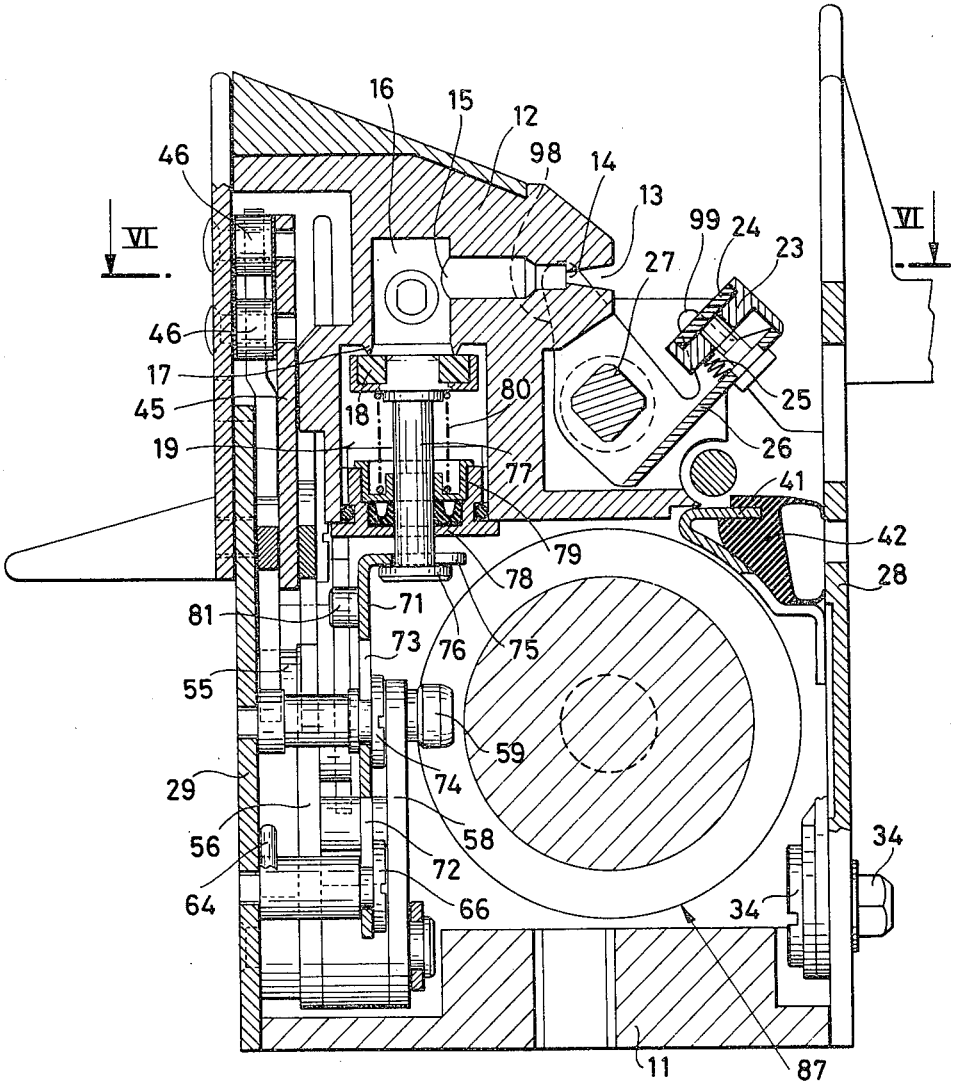
Figure 5:
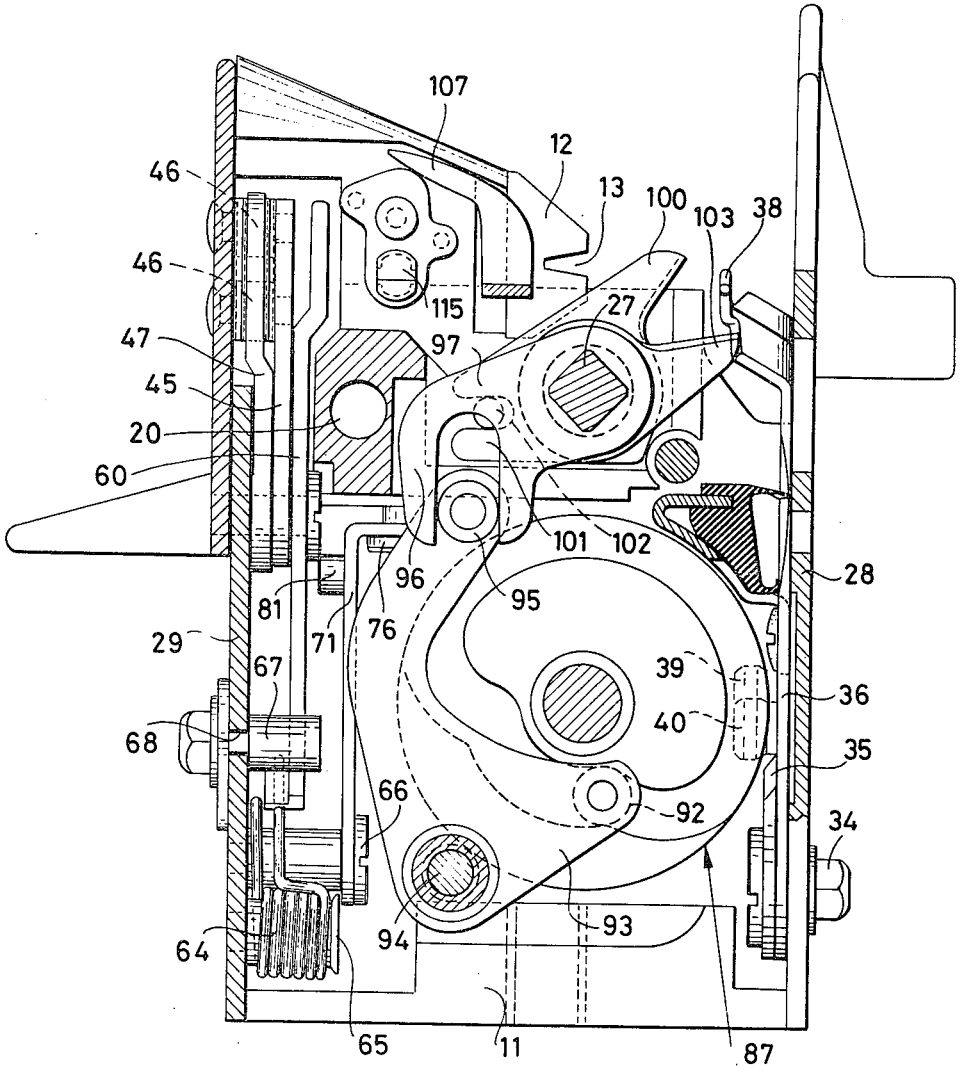
Figure 6:
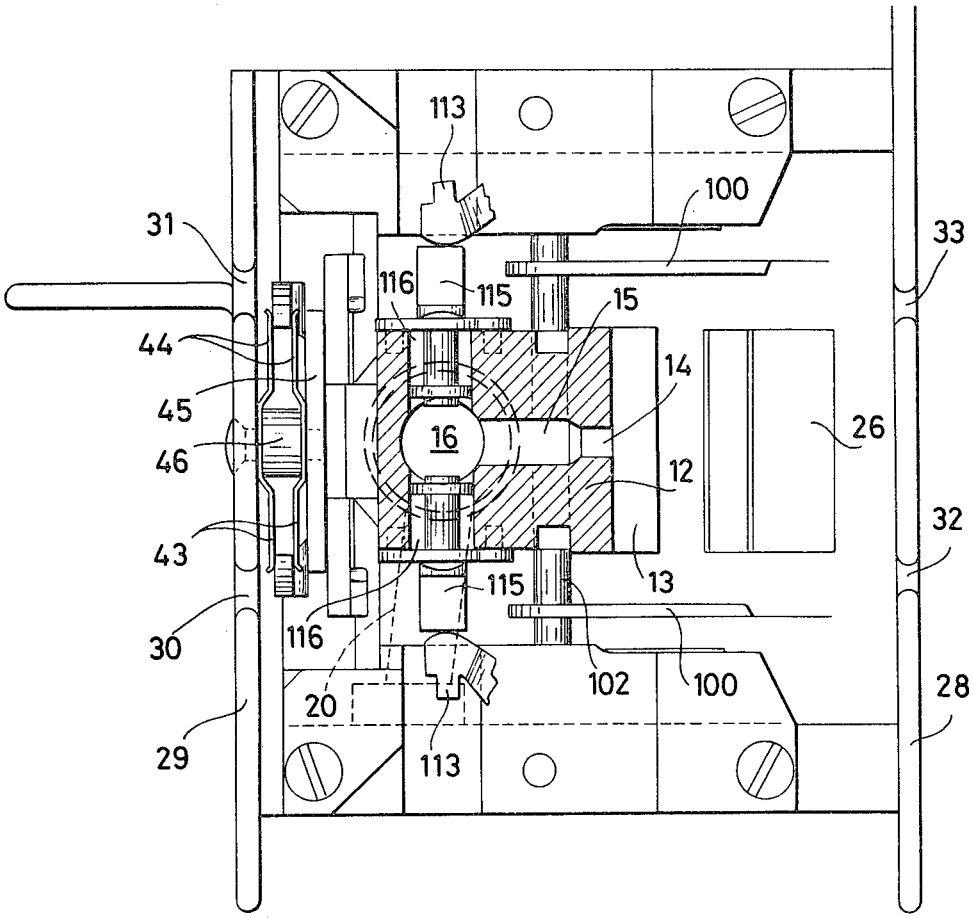
Figure 7:
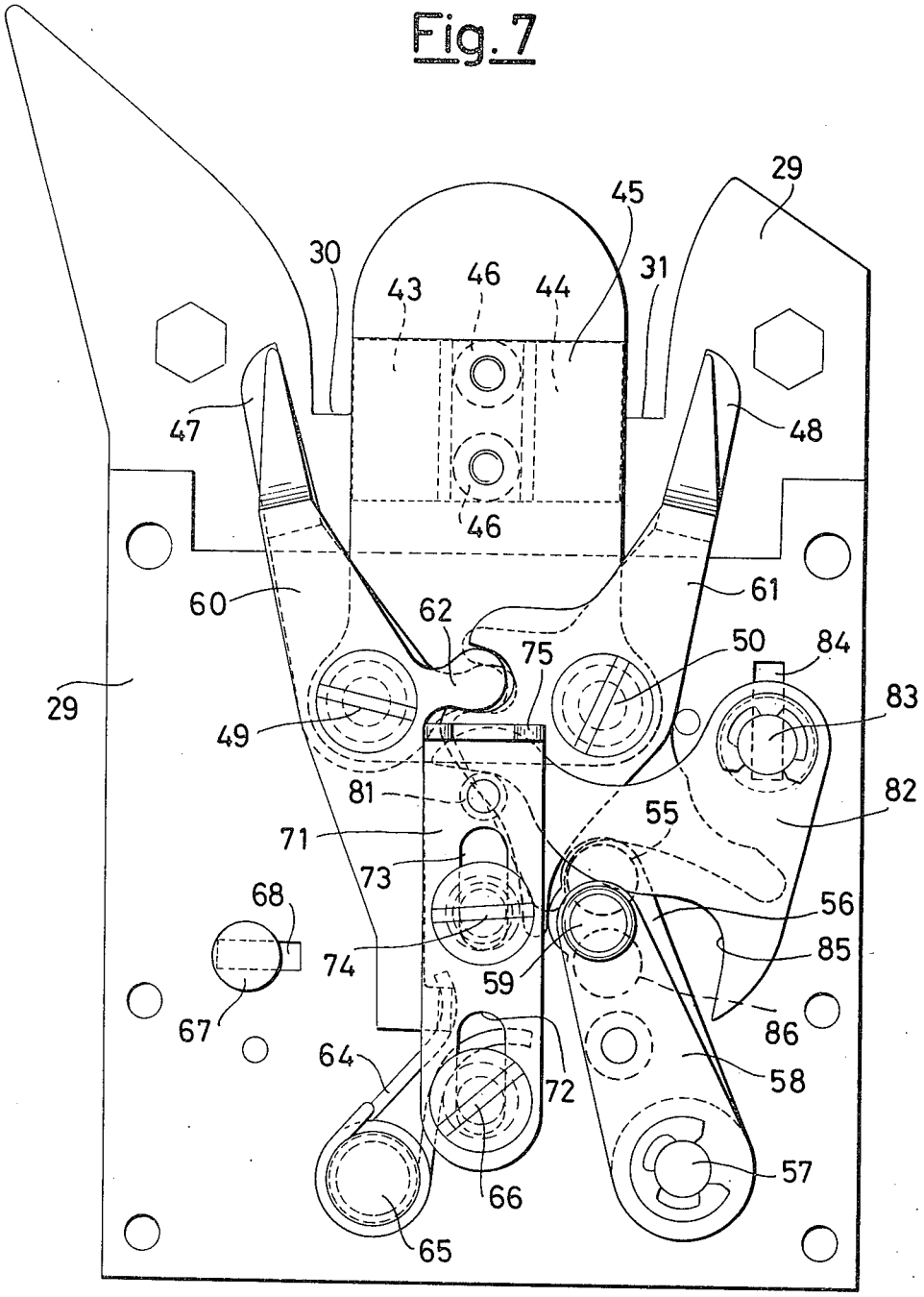
Figure 9:
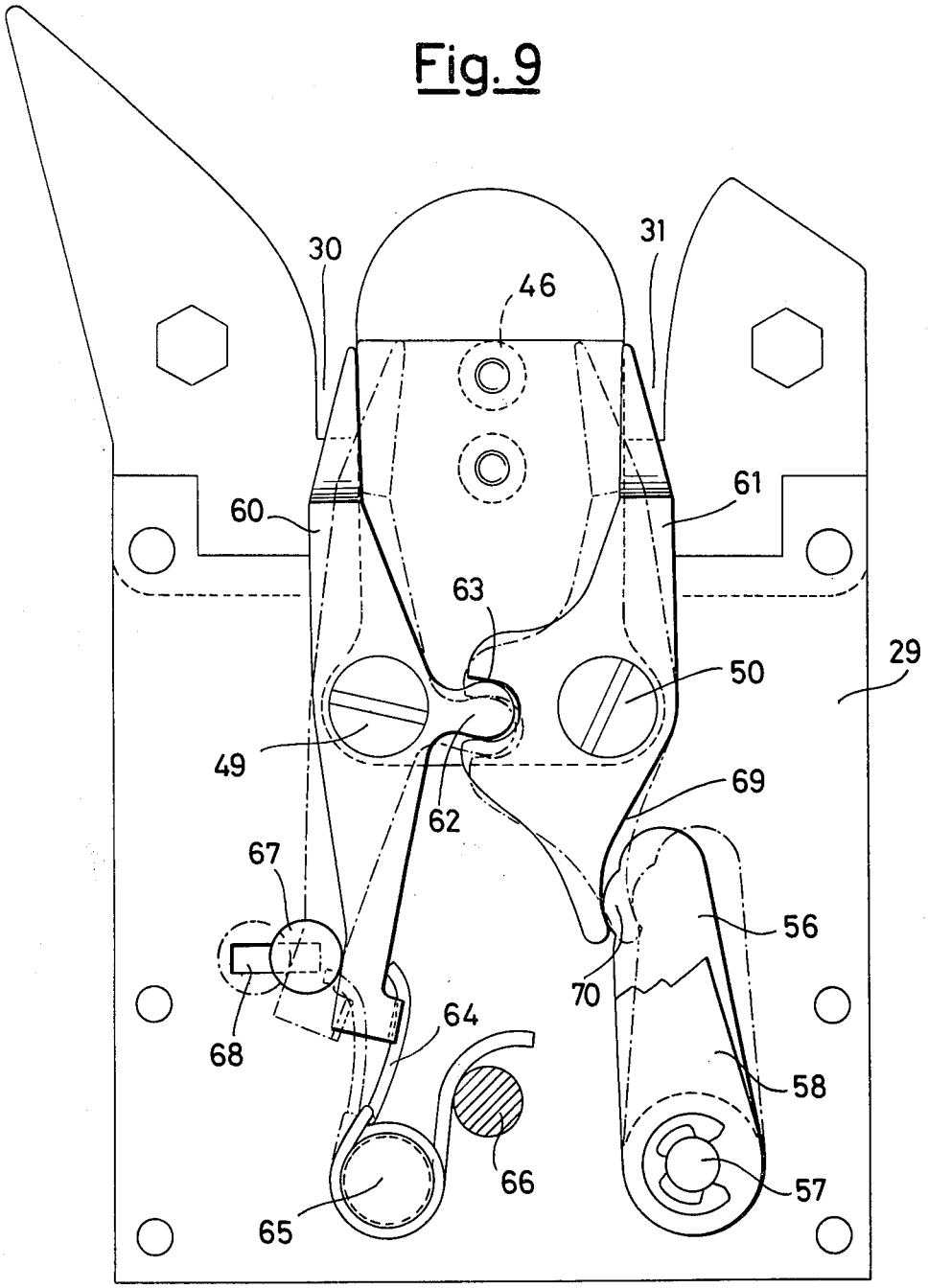
Figure 10:
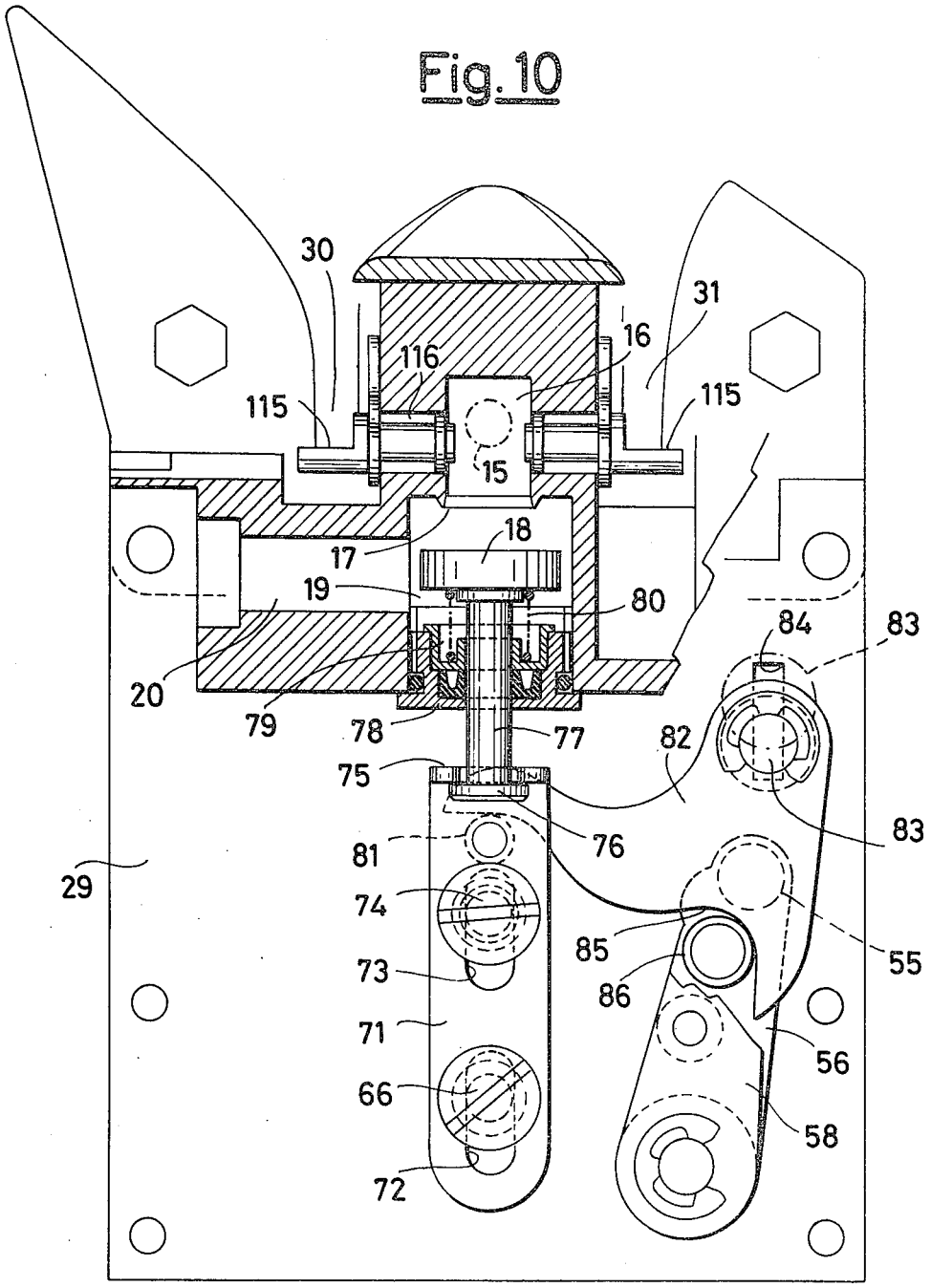
Figure 11:
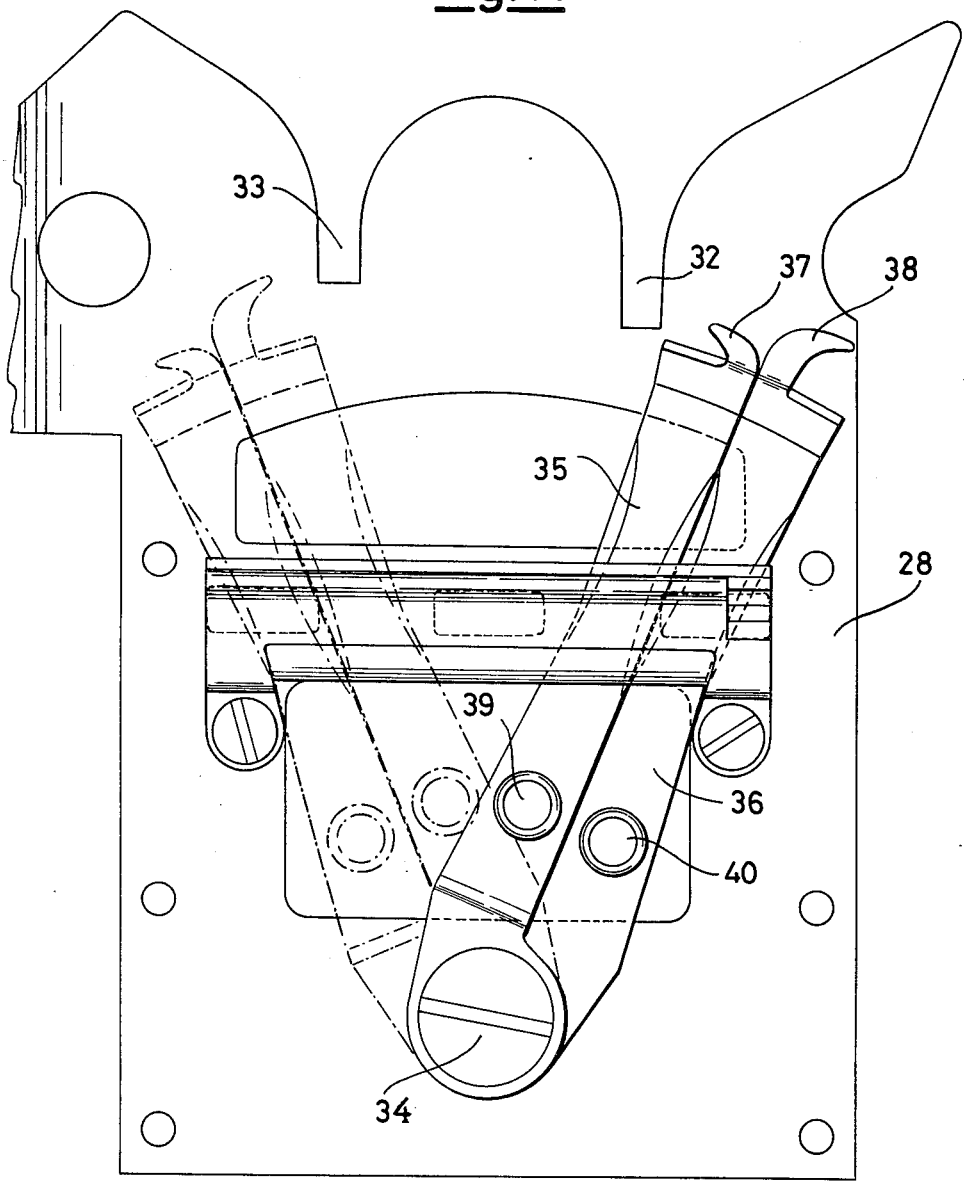

The characteristics of the joining apparatus according to the invention, its operation and the advantages attained thereby will be more apparent from the detailed description of one embodiment of the apparatus given by way of example hereinafter with reference to the accompanying drawings, in which:

FIG. 1 is a diagrammatic illustration of the location of the apparatus on an automatic winding machine, FIG. 2 is an elevational view of the apparatus, FIG. 3 is a view of the apparatus on the line III—III of FIG. 2, with one wall removed to show the control drum, FIGS. 4 and 5 are cross-sections on the lines IV—IV and V—V of FIG. 2 respectively, FIG. 6 is a section on the line VI—VI of FIG. 4, FIG. 7 shows one wall of the apparatus with the members carried thereby in a view from the interior on the line VII—VII of FIG. 2, FIGS. 8, 9 and 10 are views analogous to that of FIG. 7, with part of the members removed, and FIG. 11 shows the opposite wall to that shown in FIG. 7, with the members carried thereby, in a view from the interior on the line XI—XI of FIG. 2.

FIG. 1 shows an operational diagram of an automatic winding machine of known type. The thread is unwound from a cop 1, and passes through a fixed thread guide 2 and a mobile thread guide 3, the purpose of which is to distribute it over the spool 4 in a manner known in the art. The spool 4 is carried by a lever 5 and rests on a drum 6, which rotates the spool by friction. The fixed framework of the winding machine is indicated by 7 in the diagram of FIG. 1.

The winding machine is provided with a power take-off indicated in the example as a rotating shaft 8 with a suitable coupling member 9, and the apparatus for joining the threads, indicated overall by 10, is fixed on the framework 7 by means, not shown. A suitable position for the apparatus 10 can be that illustrated in the region between the winding machine thread guides 2 and 3.

Instead of being located in a fixed position, the apparatus 10 can also be mounted slidably on the winding machine so that it can serve a plurality of cop-spool pairs according to requirements.

Arrangements of this kind are well known in the case of automatic winding machines, and it is therefore not necessary to consider them in greater detail.

It should also be noted that the winding machine is provided with suitable means, not shown, by which the two threads to be joined together can be automatically inserted into the joining apparatus 10 in the case of a breakage of the thread between the cop 1 and spool 4 and at the beginning of the operation. In particular, the apparatus according to the invention is designed for mounting on automatic winding machines which provide for inserting the two threads from the same side of the apparatus, specifically from the top downwards as shown in FIG. 1, as indicated in this figure by dashed lines.

After this introduction, a detailed description will now be given of the apparatus 10 for joining textile threads with the aid of compressed air, with reference to FIGS. 2 to 11.

The apparatus 10 comprises a support structure 11 which includes a block 12 in which a mixing chamber 13 (FIGS. 4 and 5) substantially of V cross-section and of a certain length is formed. The chamber 13 is open at its two sides and front (see also FIG. 6). An aperture 14 opens in the centre of the base of the chamber 13, and by way of ducts 15, 16 formed in the block 12 is connected to the seat 17 of a shut-off valve 18 which acts in a hermetically sealed chamber 19 connected by a duct 20 to a connector 21 for a flexible hose 22 (FIG. 1) leading to a compressed air source, not shown. The mixing chamber 13 can be closed at its front by a cover 23 which can be fitted with a pad 24 of rubber or the like, carried in an elastically yieldable manner (by means of springs 25) by a mobile support 26 in the form of a bracket. The support 26 is fixed to a shaft or pin with portions of square cross-section 27 mounted freely rotatable in supports (not shown) of the structure 11.

Two opposing walls 28, 29 which are parallel to each other and to the longitudinal axis of the mixing chamber 13 are fixed to the structure 11. The wall 28 is disposed at a distance in front of the front mouth of said chamber, while the wall 29 is disposed behind the block 12 comprising the chamber.

The two walls 28, 29 carry various members designed to act on the threads to be joined, as will be apparent hereinafter.

Firstly, guides 30, 31 and 32, 33 respectively are provided in the walls for the correct positioning of the threads to be joined. The two threads are inserted into these guides by suitable means provided on the automatic winding machine, the insertion being made such that both the thread originating from the cop 1 and the thread which terminates at the spool 4 enter the apparatus from the same side, i.e. from the side comprising the wall 29.

It should be noted that the two pairs of guides, i.e. the guides 30 and 32 and the guides 31 and 33 formed in the walls 28, 29 are aligned along parallel axes which are perpendicular to the axis of the mixing chamber 13, and pass in the vicinity of the two lateral sides of said chamber, as can be seen in FIG. 2. Consequently, after the insertion into said pairs of guides 30, 32 and 31, 33, one thread is disposed in the vicinity of the left hand side and the other at the right hand side of the chamber with reference to FIG. 2. It should also be noted that the two guides 32, 33 formed in the well 28 disposed in front of the front mouth of the chamber 13 are at different heights, the guide 32 being lower than the guide 33.

Two levers 35 and 36, each provided at its free end with a hook 37 and 38 respectively, are mounted on the inside of the wall 28 (FIG. 11) to swivel about a single pin 34. The hook 37 of the lever 35 is substantially at the same height as the lower guide 32, while the hook 38 of the lever 36 is substantially at the same height as the higher guide 33.

The two levers 35 and 36 with their respective hooks 37 and 38 constitute members for crossing-over the threads in the region between the wall 28 and mixing chamber 13, as will be explained hereinafter.

Each lever 35, 36 carries a roller 39, 40 respectively, by way of which it receives its command for angularly moving about the axis of the pin 34.

A section 41 provided with a double-lip dust protection gasket 42, is fixed to the wall 28, and the two levers 35, 36 move between this gasket 42 and the inner surface of the wall 28.

Figure 8:
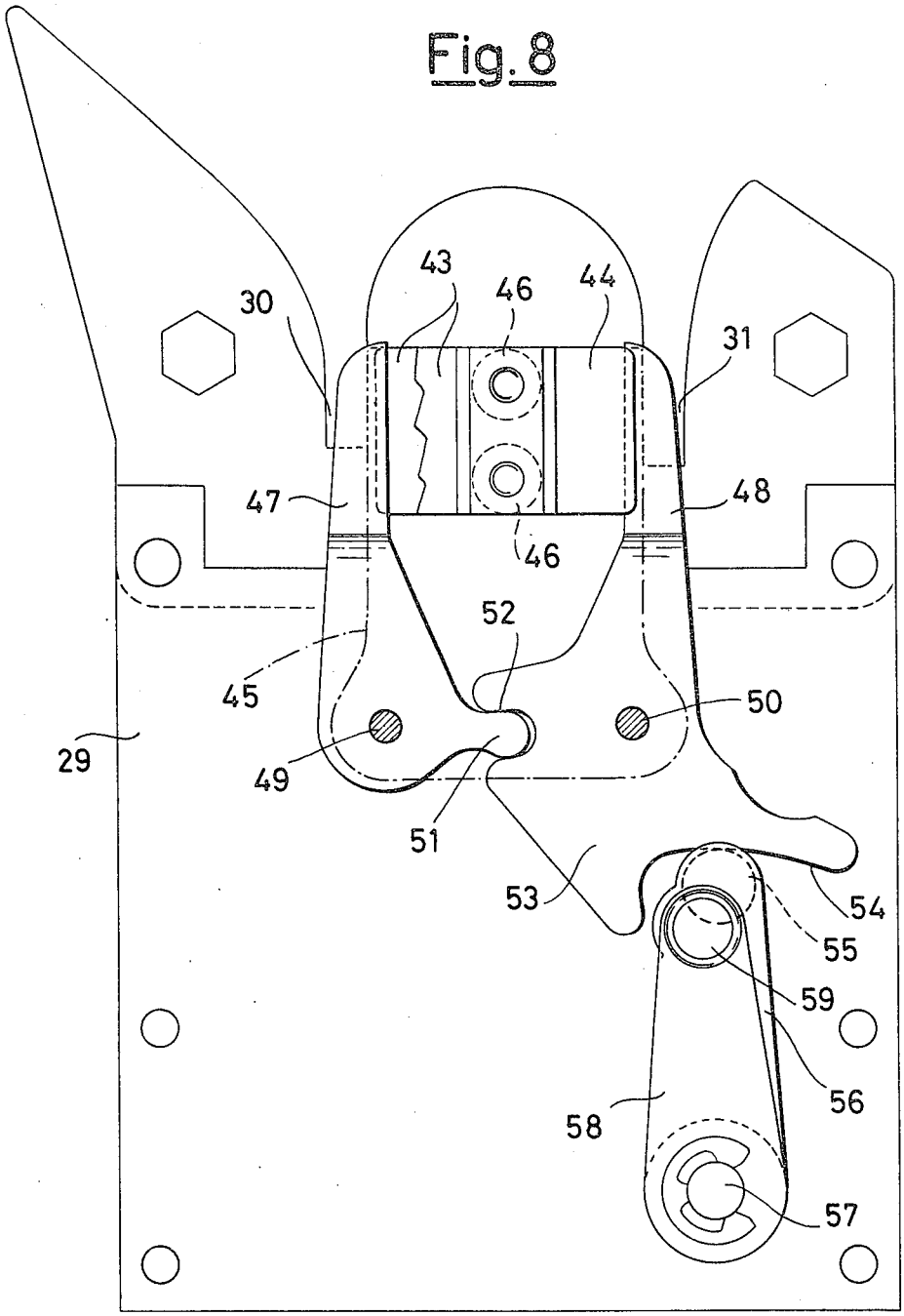

The following members, which are illustrated overall in FIG. 7 and shown individually in FIGS. 8, 9 and 10, are mounted on the inside of the opposing wall 29. The wall 29 firstly carries the members for locking the threads at the points in which they enter the apparatus. These locking members (see FIG. 8 in particular) are constituted by fixed elements and mobile elements. The fixed elements comprise pairs of flexible strips 43 and 44 (see also FIG. 2) mounted between the wall 29 and a plate 45 fixed by spacers 46 at a certain distance from said wall in the region between the two guides 30, 31. The pair of strips 43 forms a free space open towards the guide 30, and the pair of strips 44 forms a free space open towards the guide 31.

Levers 47, 48 constituting the mobile elements of the locking members are arranged to cooperate with said pairs of strips 43 and 44 respectively. The two levers 47, 48 are swivel-mounted about respective pins 49, 50 which also serve for fixing the plate 45 to the wall 29. The levers 47, 48 move between the wall 29 and plate 45, and their free ends are arranged to penetrate between the pair of strips 43 and 44 respectively. The lever 47 comprises a round projection 51 which is engaged with a recess 52 provided in the lever 48. This latter lever also comprises a second profiled arm 53 with a profiled edge 54 with which there cooperates a pin 55 carried by a control lever 56 pivoted at 57 to the wall 29. It should be noted that the pin 55 is fixed to the lever 56 on that side thereof which faces the wall 29.

A second lever 58, also pivoted at 57, is rigid with the lever 56 but in a plane parallel thereto which is more distant from the wall 29, and carries a roller 59 by way of which the pair of levers 56, 58 receives their command for moving angularly about the axis of the pin 57.

The wall 29 also carries mobile members for adjusting the length of the free ends of the two threads to be joined together. These adjusting members (see FIG. 9 in particular) are constituted by two double arm levers 60 and 61 also mounted to swivel about the pins 49 and 50 respectively, but at the other end of the plate 45 to the levers 47 and 48, i.e. in a plane which is more distant from the wall 29. The ends of the upper arms (as seen in FIG. 9) of said levers 60, 61 are arranged to act on the two thread ends inserted into the guides 30 and 31. The lever 60 comprises a round projection 62 which engages with a recess 63 provided in the lever 61. One end of a spiral spring 64 wound about a pin 65 fixed to the wall 29 acts on the lower arm of the lever 60, while its other end rests against a further pin 66 fixed to the wall 29. The spring 64 tends to keep the lower arm of said lever 60 in contact with an adjustable stop 67, and thus keeps both levers 60 and 61 in a predetermined position. The stop 67 can be moved and locked into the required position in a slot 68 provided in the wall 29. FIG. 9 shows the two end-of-adjustment positions of the stop 67 and the relative positions assumed by the two levers 60 and 61 under the thrust of the spring 64. When the stop 67 has been moved completely to the right of the slot 68 (as shown in FIG. 9), the ends of the upper arms of the levers 60, 61 are halted under the thrust of the spring 64 substantially in line with the inner edges of the guides 30 and 31 (position indicated by full lines), whereas when the stop 67 is moved completely to the left in the slot 68, the ends of the upper arms of the levers 60, 61 can move more closely together. In the first case, the levers 60, 61 cause practically no withdrawal of the free ends of the two threads to be joined together, and these free ends then have maximum length, whereas in the second case the free ends are correspondingly withdrawn and have minimum length. By adjusting the stop 67 to an intermediate position, the length of the free ends of the threads to be joined together has an intermediate value between the maximum and minimum values.

The lower arm of the lever 61 has a profiled edge 69, with which there cooperates a profiled part 70 of the central lever 56 pivoted at 57 and rigid with the lever 58.

It should be noted that in FIG. 7 the members for locking the threads and the members for adjusting the length of their free ends are shown in their rest positions, whereas in FIGS. 8 and 9 the same members are shown in their respective working positions. The operating means for the shut-off valve 18 are mounted on the inside of the wall 29. These means consist substantially of a slider 71 (see FIGS. 4 and 10) provided with two longitudnal slots 72, 73 by which it is guided on two pins 66 and 74 fixed to the wall 29. Spacers are mounted on the pins 66 and 74 to keep the slider 71 in a plane which is parallel to the wall 29 but is at a greater distance therefrom than the plane in which the levers 60, 61 move (see FIG. 4). The slots 72, 73 limit the maximum stroke of the slider 71. Upperly (as shown in FIGS. 4 and 10), the slider 71 comprises a fork 75 disposed at 90° to the slider plane, and said fork 75 is engaged with the free end 76 of the stem 77 of the valve 18. The stem 77 passes in a sealed manner through a cover 78 which closes the chamber 19 in which the valve 18 acts. A spiral spring 80 acts between a cover insert 79 rigid with the cover 78 and the valve 18 (FIG. 4), and tends to keep the valve 18 pressed against its seat 17 and thus close the passage for the compressed air reaching the chamber 19 on its path towards the ducts 15, 16 and towards the aperture 14 in the mixing chamber 13. The spring 80 thus also keeps the slider 71 raised (as shown in FIGS. 4 and 10), this slider being hooked to the end 76 of the stem 77 of the valve 18.

On the side facing the wall 29, the slider 71 carries a pin 81 on which can act the end of a lever 82 mounted to swivel about a pin 83 fixed in an adjustable position to the wall 29. The pin 83 carries a suitable spacer for keeping the lever 82 in a plane spaced apart from and parallel to the wall 29, so that its end can act on the pin 81 carried by the slider 71.

The pin 83 can be moved and locked in the required position in a slot 84 provided in the wall 29, and the two end positions which said pin 83 can assume are shown in FIG. 10.

The lever 82 comprises a profiled edge 85, with which a second pin 86 carried by the control lever 56 on the opposite side to the pin 55 can cooperate.

As is apparent from FIG. 10, when the fulcrum (pin 83) of the lever 82 is adjusted to its lowest position in the slot 84, rotation of the control lever 56 causes the pin 86 to induce maximum rotation of the lever 82 and thus maximum stroke of the slider 71, corresponding to maximum time of opening of the shut-off valve 18. In contrast, when the pivot of the lever 82 is adjusted to its highest position in the slot 84, the stroke of the slider 71 is minimum, as is the time of opening of the valve 18.

From the aforegoing, it is apparent that the single control lever 56 and lever 58 rigid therewith control three different types of member mounted on the wall 29, the mobile elements 47, 48 of the locking members for the threads to be joined together being controlled by means of the pin 55, the levers 60, 61 which adjust the length of the free ends of the threads being controlled by its profiled part 70, this control being adjustable, and finally the slider 71 for opening the shut-off valve 18 being controlled by the pin 86, this control also being adjustable.

A control drum 87 better seen in FIG. 3 is supported in suitable bearings (not shown) in the structure 11 of the apparatus 10 for causing the rocking movements of the pair of levers 56, 58 and of the levers 35 and 36 which constitute the cross-over members for the threads.

The drum 87 comprises three circumferential grooves 88, 90, 89 which are suitably profiled to positively determine the required synchronised movements of the various members in the required succession.

The roller 59 carried by the lever 58 rigid with the lever 56 is inserted into the groove 88, and the rollers 39 and 40 carried by the levers 35 and 36 for crossing over the yarn ends are inserted into the grooves 89 and 90 respectively.

The drum 87 can be coupled by the coupling member 9 to the shaft 8, which constitutes the power take-off of the automatic winding machine, for its rotation. It should be noted that one 360° revolution of the drum 87 corresponds to one complete joining cycle for two threads.

At one end of the drum 87 (the left hand end in FIG. 3) there is provided a frontal groove cam 91 (see FIG. 5), with which there cooperates a roller 92 carried by an arm of a double arm lever 93 pivoted at 94 to the structure 11. The other arm of the lever 94 carries a roller 95 which engages with the forked end 96 of a lever 97 rigid with the square pin 27 on which the support 26 for the cover 23 is fixed. As the lever 93 rocks about its pivot 94 under the control of the frontal cam 91 of the control drum 87, the cover 23 is moved from a rest position (shown in FIG. 4) withdrawn from the mixing chamber 13, to a position in which it frontally closes said chamber in a sealed manner.

On both its sides, the support 26 for the cover 23 comprises projecting arms 98 which act as extractors for extracting the threads from the chamber 12 after they have been joined together, as will be explained hereinafter. The two arms 98 move together with the cover 23 in close vicinity to the two sides of the chamber 13.

The support 26 for the cover 23 also carries, on its two sides, small levers 99 (FIG. 3) which serve for exactly positioning the threads to be joined together during their insertion into the chamber 13.

Cutting members for the free ends of the threads are also mounted on the pin 27 carrying the support 26 for the cover 23, on the two sides of the support 26. Each of these cutting members comprises a fixed blade 100 (FIG. 5), which by means of a hole therein is mounted on the pin 27 so that this latter can rotate freely relative to the fixed blade. A forked end 101 of the fixed blade 100 is engaged on a rod 102 mounted with its axis parallel to the axis of the pin 27 in the structure 11 so that the fixed blade is prevented from rotating. With the fixed blade 100 there cooperates a mobile blade 103 which is made rigid with the pin 27 and thus follows its rotary reciprocating movement. A spring 104 acting between the support 26 and fixed blade 100 keeps this fixed blade pressed against the mobile blade 103.

Supports 106 (see FIG. 2) in the shape of square arms are fixed by screws 105 on to the structure 11, at the two sides of the block 12, and are provided with beak-shaped portions 107 (see also FIG. 5) for correctly guiding the threads on their insertion into the apparatus. A double armed lever 109 is mounted to swivel about a pivot 108 on each support 106, and at the end of one of its arms carries a locking element 110 arranged to cooperate with the base of the relative beak-shaped portion 107 in order to lock the relative thread immediately on leaving the mixing chamber 13. A spring 111 acting between a projection 112 on the support 106 and a projection 113 at the end of the other arm of the lever 109 tends to keep the locking element 110 removed from the relative beak-shaped portion 107 (as shown in FIG. 2). On the opposite side to the projection 113, said other arm of the lever 109 rests against a piston 115 slidable in a sealed manner in a chamber 116 provided in the block 12. As is clear in FIG. 6, the two chambers 116 which receive the opposing pistons 115 are coaxial, and both open into the duct 16 which by way of the duct 15 is in communication with the aperture 14 which opens into the mixing chamber 13. It is therefore apparent that when the shut-off valve 18 is opened and the compressed air thus reaches the duct 16, the two pistons 115 are urged outwards from their respective chambers 116, so that by overcoming the force of the springs 111 they cause the levers 109 to rotate about their pivots 108 so as to bring the locking elements 110 into contact with the bases of the respective beak-shaped portions 107 and to thus lock the threads in the immediate vicinity of their outlet from the mixing chamber. The purpose of this locking is to prevent the shaking movement which the threads undergo as they are joined together by the compressed air in the mixing chamber 13 from being able to propagate outside said chamber as far as the locking points at the wall 29 between the flexible strips 43 and 44 respectively and the relative levers 47, 48.

The operation of the described apparatus is as follows.

It should be noted that on the drawings (with the exception of FIGS. 8, 9 and 10), all the members of the apparatus are shown in their rest position.

When the thread breaks between the cop 1 and the spool 4 on the automatic winding machine, the members provided on the winding machine for taking hold of the thread from the cop 1 and the other thread from the spool 4 come into operation. These members, which generally consist of suitable mobile arms fitted with suction ports for retaining the relative threads under tension, automatically insert the two threads into the apparatus 10, as indicated diagrammatically by dashed lines in FIG. 1. The insertion is made such that both the threads enter the apparatus from the side which contains its wall 29, and leave the apparatus by way of their free ends from the side containing its wall 28, where the ends of the threads are retained by said winding machine suction members. In particular, the thread originating from the spool 4 can be disposed in the guides 30, 32, and that originating from the cop 1 can be disposed in the guides 31, 33. In this situation, the two threads are thus located at the sides of the mixing chamber 13 perpendicular to the longitudinal axis thereof. It should be noted that each thread is arranged in the space between the relative beak-shaped portion 107 and the locking element 110. The shape of the beak portions 107 and block 12 facilitates this arrangement of the threads. As soon as the threads to be joined together have been inserted into the joining apparatus 10, the power take-off 8, 9 of the automatic winding machine is started and rotates the control drum 87, to commence the joining operation which is carried out within the period of one complete revolution of the drum 87, after which the power take-off 8, 9 stops automatically.

The first stage in the operation is the crossing-over of the threads by means of the levers 35, 36 which are controlled by the profiled grooves 89, 90 of the drum 87. From the position in which they are displaced entirely to the right in FIG. 11, both the levers 35, 36 are firstly displaced entirely to the left so that the hook 37 of the lever 35 grips the thread passing through the guide 32 and moves it completely to the left, but the hook 38 of the lever 36 does not grip the thread passing through the guide 33. The lever 35 then remains to the left and retains the relative thread in its displaced position, and the lever 36 moves alone to return to the right. During this movement, its hook 38 carries the thread passing through the guide 33 to the right. At the end of the crossing-over stage, the lever 35 with the thread retained by it is to the left (with reference to FIG. 11), and the lever 36 with the other thread retained by it is to the right. The two threads are thus crossed-over in the region between the wall 28 and mixing chamber 13, these threads being guided about the base of the beak-shaped portions 107, then passing into the relative guides 30, 31 in the opposing wall 29. It should also be noted that the levers 47 and 48 have already commenced their mutual approach movement in this stage, but without as yet locking the threads between the pairs of flexible strips 43 and 44.

Following the crossing-over of the two threads, the frontal cam 91 of the control drum 87, by means of the levers 93 and 97, induces the closure movement of the cover 23 and the movement of the mobile blades 103 of the cutting members. During the closure movement of the cover 23, the levers 99 rigid with its support 26 guide the threads during their insertion into the mixing chamber 13, and position them exactly therein. Immediately after the frontal closure of the chamber 13 by the cover 23, the mobile blades 103 in cooperation with the fixed blades 100 cut the free ends of the threads. After these free ends have been cut, the levers 47 and 48, controlled by the cam 88, lock the threads between the pairs of blades 43 and 44 at the wall 29, and thus the levers 60 and 61 also come into operation for adjusting the length of the cut free ends of the two threads.

The slider 71 then opens the shut-off valve 18, and compressed air flows into the duct 16. The pistons 115 are thus urged outwards and rotate the levers 109 in order to lock the threads in the immediate vicinity of the outlet of the mixing chamber 13, between the locking elements 110 and the bases of the beak-shaped portions 107. At the same time, the compressed air also enters the chamber 13 through the aperture 14, and the two threads are joined together by mixing and interweaving their fibres. The time of action of the burst of compressed air in the mixing chamber 13 for a given rotational speed of the control drum 87 depends on the profile of the cam 88 which determines the opening and closure times of the shut-off valve 18, and on the adjustment of the pin 83 in the slot 84. As soon as the cam 88 enables the slider 71 to be pushed downwards (as shown in FIG. 4) by the spring 80, the valve 18 closes and the thread joining stage thus terminates. Simultaneously, under the thrust of the springs 111, the pistons 115 and levers 109 return to their initial position, and the joined threads are released by the locking elements 110. The cover 23 now begins its opening movement, and by means of the projecting arms 98 leads to the extraction of the joined threads from the chamber 13. Towards the end of the opening movement of the cover 23, the pairs of levers 47, 48 and 60, 61 return to their initial position, whereas the lever 35 which has performed the crossing-over operation had already returned to its initial position during the thread joining stage, i.e. during the entry of the burst of compressed air into the mixing chamber.

The rotation of the spool 4 and the movement of the mobile thread guide 3 are then re-started by the winding machine, so that the joined thread becomes completely extracted from the apparatus 10. This extraction is facilitated by the concave shape of the block 12. The control drum 87 stops in its initial position as the power take-off 8, 9 is stopped. The apparatus 10 with all its mobile members is ready for a further operation.

The apparatus according to the invention is constructionally simple, and therefore allows safe operation with high reliability. The movements of all its mobile members are controlled by cams provided on a single drum, these cams being of the direct control type and therefore not requiring resilient means which could be subject to fatigue. Consequently, the joining operation can be carried out at high speed, and the operation is reliable and constant with time. Because of the original concept of controlling the movements of three different members by means of a single cam, namely the cam 88 of the drum 87, construction can be simplified and the overall size of the apparatus be considerably reduced.

By crossing the threads over before inserting them into the mixing chamber, they attain a more favourable position in said chamber for proper joining.

Because of the facility for adjusting the length of the free ends of the threads between a maximum length and a minimum length, and because of the facility for adjusting the duration of the burst of compressed air in the mixing chamber between a maximum time and a minimum time, the apparatus can be easily adapted to various operating requirements, particularly to various thread types in terms of count, fibre length and type of textile fibre.

Various modifications can be made to the embodiment of the apparatus described heretofore by way of example, without leaving the scope of the present invention.

We claim:

1. An apparatus for joining textile threads with the aid of compressed air, designed for mounting on an automatic winding machine provided with means for inserting both the yarns to be joined together from the same side of the apparatus, and with a power take-off for operating the apparatus, comprising a support structure with a block in which a laterally and frontally open mixing chamber substantially of V cross-section is formed, an aperture opening centrally at the base of said chamber and connected by way of a shut-off valve to a compressed air source, a cover carried by a support movably mounted in said structure so as to frontally close said chamber, means for controlling the movement of said cover from a rest position withdrawn from the chamber to a frontal closure position therefor, means synchronised with said cover movement control means for causing said shut-off valve to open for a predetermined time when the cover is in the position in which it closes the chamber, fixed guides for positioning the threads to be joined together, locking members for the threads constituted by fixed and mobile elements, members constituted by fixed and mobile blades for cutting the free ends of the threads, and means for controlling the mobile elements of the locking members and the mobile blades of the cutting members in synchronism with the movement of the cover, characterised in that said structure is provided with two opposing walls which are parallel to each other and to the longitudinal axis of the mixing chamber and disposed at a distance respectively in front of and behind the block comprising said chamber, the thread positioning guides being provided in said walls in aligned pairs to receive the threads to be joined together along parallel axes perpendicular to the axis of the chamber and passing to the side of this latter, the two guides provided in the wall disposed in front of the chamber being at different heights, on said wall disposed in front of the chamber there being mounted rocking means for crossing-over the threads in the region between said wall and the mixing chamber, the mobile and fixed elements of the members for locking the threads and of the mobile levers for adjusting the length of the free ends of the threads being mounted on the wall disposed behind the block comprising the mixing chamber in positions corresponding to the positioning guides provided in this wall, on the same wall there being mounted a member for operating the shut-off valve, the cutting members being disposed at the two sides of the mixing chamber with the mobile blades rigid with the support for the chamber closure cover, in said structure there being mounted a control drum which is rotatable about its axis, can be coupled to said power take-off of the winding machine, and is provided with a plurality of cam profiles for controlling the movements of the members for crossing-over the threads, the mobile elements of the members for locking the threads, the mobile levers for adjusting the length of the free ends of the threads, the operating member for the shut-off valve and the cover with the mobile blades of the members for cutting the threads.

2. An apparatus as claimed in claim 1, characterised in that the control drum is provided with a first cam profile with which there cooperates a control lever pivoted to the wall disposed behind the block comprising the mixing chamber, said control lever being linked to the mobile elements of the locking members, to the mobile levers for adjusting the length of the free ends of the threads, and to the operating member for the shut-off valve, and is also provided with a second and third cam profile for controlling each of said cross-over members, and a fourth cam profile with which there cooperates a lever pivoted to the support structure and arranged to act on the support for the mixing chamber cover.

3. An apparatus as claimed in claim 2, characterised in that the first three profiles are constituted by profiled circumferential grooves provided in the periphery of the control drum, whereas the fourth profile is constituted by a front groove cam provided at one end of said drum.

4. An apparatus as claimed in claim 2, characterised in that the mobile elements of the locking members and the mobile levers for adjusting the length of the free ends are swivel-mounted on two pins rigid with the wall disposed behind the block comprising the mixing chamber, said mobile elements being disposed in a plane which is parallel and close to said wall, and said levers being disposed in a plane which is parallel to but further from said wall, both said two mobile elements and said two levers being coupled together by respective projections and recesses, one of said mobile elements and one of said levers having a profiled edge with which a first pin rigid with said control lever and a profiled part thereof cooperate respectively, and said shut-off valve operating member is constituted by a slider engaged with the valve stem and mounted so that it can move linearly to a limited degree on said wall in a plane parallel to but still further distant from the wall than the plane in which said levers for adjusting the length of the free ends are disposed, said slider carrying a pin with which there cooperates an intermediate lever pivoted on the wall and having a profiled edge with which a second pin rigid with the control lever cooperates.

5. An apparatus as claimed in claim 4, characterised in that the other of said levers for adjusting the length of the free ends is maintained with a part thereof resiliently in contact with a stop mounted in an adjustable and lockable manner in a slot provided in said wall.

6. An apparatus as claimed in claim 4, characterised in that the pivot of said intermediate lever which cooperates with the slider is mounted in an adjustable and lockable manner in a slot provided in said wall.

7. An apparatus as claimed in claim 2, characterised in that said lever cooperating with the fourth profile of the control drum engages with a lever fixed on the shaft which carries the mixing chamber closure cover support.

8. An apparatus as claimed in claim 1, characterised in that supports are mounted on the support structure at the two sides of the block comprising the mixing chamber, and each is provided with a beak-shaped guide element which is matched to the shape of said block and on each of which is swivel-mounted a lever carrying a locking element arranged to cooperate with the base of said guide element, there being provided resilient means for keeping said locking element withdrawn from the relative guide element, and means for causing it to approach this latter in synchronism with the opening of the shut-off valve.

9. An apparatus as claimed in claim 8, characterised in that said means for causing the locking element to approach the relative guide element consist of a piston acting on the lever which carries the locking element, said piston being slidable in a sealed manner in a chamber which communicates with a duct disposed between the shut-off valve and the aperture which opens into the mixing chamber.

10. An apparatus as claimed in claim 1, characterised in that the support for the mixing chamber closure cover carries, at its two sides, extractor arms which lie in planes perpendicular to the longitudinal axis of the chamber and which pass at a short distance from the sides thereof.

11. An apparatus as claimed in claim 1, characterised in that the support for the mixing chamber closure cover carries, at the two sides of the cover, levers for positioning the threads inside the chamber.

12. An apparatus as claimed in claim 1, characterised in that the support for the mixing chamber closure cover is fixed on a shaft which is swivel-supported in the support structure, the fixed and mobile blades of the cutting members being mounted on said shaft at the two sides of the cover support, the shaft being freely rotatable relative to the fixed blades whereas the mobile blades are rigid with the shaft, between the sides of the support and the fixed blades there being provided resilient means which urge the fixed blades against the mobile blades, the fixed blades being engaged by their ends with a rod which prevents their rotation about the axis of said shaft.

* * * * *